US009945393B2

(12) United States Patent
Baltes et al.

(10) Patent No.: US 9,945,393 B2
(45) Date of Patent: Apr. 17, 2018

(54) PRESSURE ACCUMULATOR

(71) Applicant: Hydac Technology GmbH, Sulzbach/Saar (DE)

(72) Inventors: Herbert Baltes, Losheim (DE); Peter Kloft, Ransbach-Baumbach (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 472 days.

(21) Appl. No.: 13/261,842

(22) PCT Filed: Oct. 18, 2012

(86) PCT No.: PCT/EP2012/004368

§ 371 (c)(1),
(2) Date: Apr. 10, 2014

(87) PCT Pub. No.: WO2013/056834

PCT Pub. Date: Apr. 25, 2013

(65) Prior Publication Data

US 2014/0299609 A1 Oct. 9, 2014

(30) Foreign Application Priority Data

Oct. 20, 2011 (DE) ..... 10 2011 116 517

(51) Int. Cl.

| | |
|---|---|
| ***A47G 19/22*** | (2006.01) |
| ***F15B 1/04*** | (2006.01) |
| ***F15B 1/08*** | (2006.01) |
| ***F17C 1/00*** | (2006.01) |

(52) U.S. Cl.

CPC ..... *F15B 1/04* (2013.01); *F15B 1/086* (2013.01); *F17C 1/00* (2013.01)

(58) Field of Classification Search

CPC ..... F15B 1/04
USPC ..... 220/720, 721; 138/30, 26
See application file for complete search history.

(56) References Cited

U.S. PATENT DOCUMENTS

| | | | | |
|---|---|---|---|---|
| 4,897,906 | A * | 2/1990 | Bartholomew | 29/890.09 |
| 7,918,246 | B2 * | 4/2011 | Stroganov | 138/30 |
| 8,201,582 | B2 * | 6/2012 | Stroganov et al. | 138/31 |

(Continued)

FOREIGN PATENT DOCUMENTS

| | | |
|---|---|---|
| DE | 967 721 | 12/1957 |
| DE | 695 15 899 T2 | 6/1996 |
| DE | 197 43 007 A1 | 4/1998 |

(Continued)

*Primary Examiner* — Fenn C Mathew
*Assistant Examiner* — Kevin Castillo
(74) *Attorney, Agent, or Firm* — Wenderoth, Lind & Ponack, L.L.P.

(57) ABSTRACT

A pressure accumulator has at least one accumulator housing (103) with at least one connection (111; 113) for a pressure medium (149), especially in the form of a fluid that can be accumulated in the accumulator housing (103). A filling material (119) that has hollow chambers or that forms at least one hollow chamber for accommodating at least part of the pressure medium (149) introduced into at least sections of the accumulator housing (103). An interior (117) of the accumulator housing (103) is completely filled with the filling material (119) to such an extent that the filling material (119) contacts the entire surface of a wall (120) of the accumulator housing (103).

5 Claims, 1 Drawing Sheet

(56) References Cited

U.S. PATENT DOCUMENTS

| | | | | |
|---|---|---|---|---|
| 8,646,484 | B2 * | 2/2014 | Stroganov et al. | 138/31 |
| 2010/0050622 | A1 * | 3/2010 | Stroganov | 60/413 |

FOREIGN PATENT DOCUMENTS

| | | | |
|---|---|---|---|
| DE | 197 04 968 | A1 | 7/1998 |
| DE | 20 2005 002 335 | U1 | 9/2005 |
| DE | 20 2007 008 175 | U1 | 10/2007 |
| DE | 21 2008 000107 | U1 | 12/2010 |
| WO | WO 2010/134840 | A1 | 11/2010 |

* cited by examiner

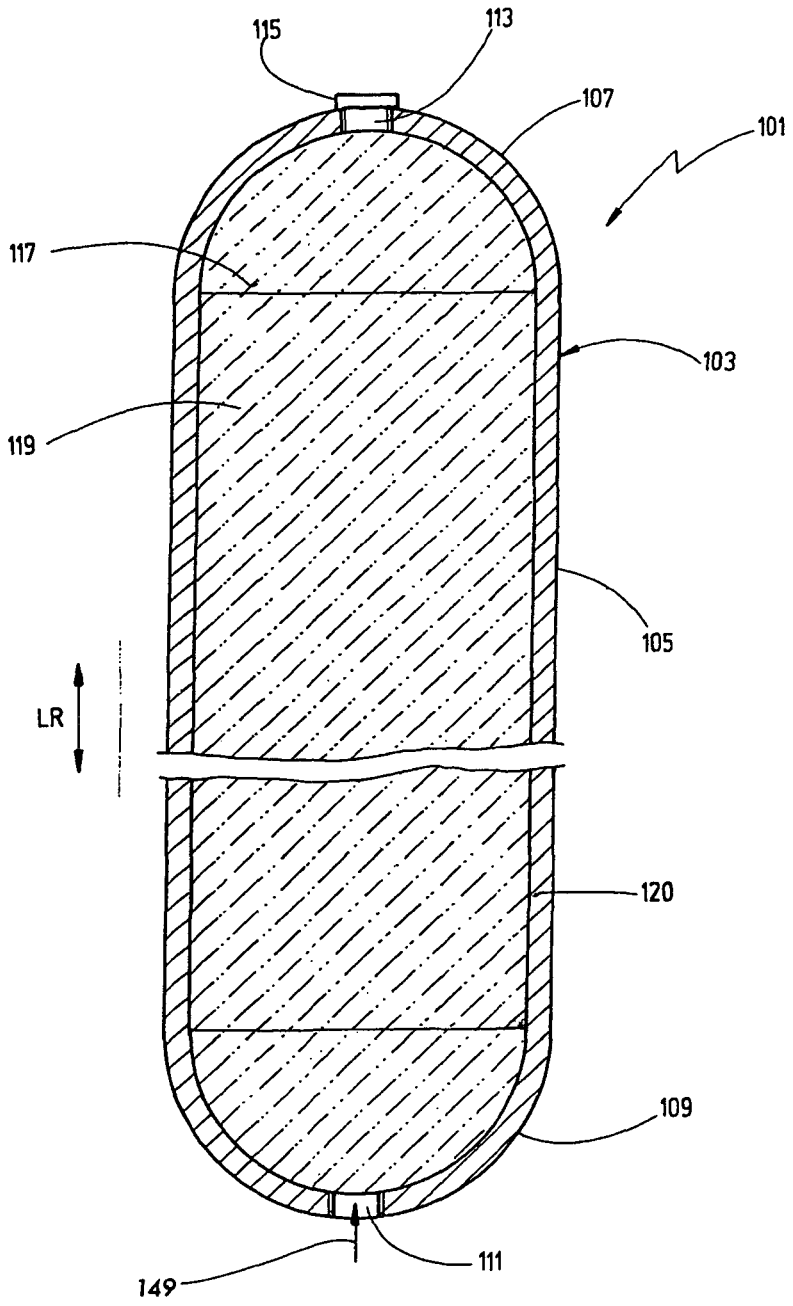
115
113
107
101
117
103
119
105
LR
120
109
111
149

PRESSURE ACCUMULATOR

FIELD OF THE INVENTION

The invention relates to a pressure accumulator having at least one accumulator housing with at least one connection for a pressure medium, in particular in the form of a fluid, that can be stored in the accumulator housing. A filling material is introduced at least partially into the accumulator housing. This material has cavities or forms at least one cavity for at least partial accommodation of this pressure medium.

BACKGROUND OF THE INVENTION

Pressure accumulators are known in various embodiments in the prior art. For example, DE 20 2007 008 175 U1 discloses a hydropneumatic pressure accumulator or hydraulic accumulator having a movable separation element disposed in an accumulator housing. The separation element separates a first working space, preferably a gas space, from a fluid space as the second working space, and is formed by a diaphragm made of a flexible material, in particular an elastomer. At least one housing opening, forming an access to the housing, is provided on the accumulator housing for accommodating and dispensing fluid, in particular in the form of hydraulic fluid.

Pressure accumulators of this type, in particular hydraulic accumulators, are subjected to high demands during operation in hydraulic systems because frequent and intense movements of the elastomeric separation element occur in predefinable operating cycles due to the fluid flowing into and out of the accumulator. These movements cause loading and relaxation separately due to the separation element with respect to the gas supply in the accumulator. Overloading and local wrinkling of the material may occur due to shearing stresses on the separation element and may result in tearing. Tearing would fundamentally make the accumulator useless, requiring the hydraulic system to be shut down, at least partially, for replacement purposes. The known pressure accumulators and hydraulic accumulators can be used regularly only as an individual solution for a restricted range of applications in hydraulic systems because of their accumulator capacity and/or their damping characteristics. This restriction leads to increased costs accordingly at both the manufacturing end and the consumer end.

DE 197 43 007 A1 describes an accumulator of the pressure accumulator type, having a housing that has a connection for a pressure medium in the manner of a hydraulic medium that can be stored in the housing. The housing contains a filling agent in the form of one or more hollow bodies filled with a pressure medium. These bodies can be compressed when a higher pressure prevails outside of the filling agent.

SUMMARY OF THE INVENTION

An object of the invention is to provide improved pressure accumulators, in particular in the form of hydraulic accumulators, while retaining their advantages, namely to ensure a high accumulator capacity, so that they will have a longer lifetime and can be adapted well to given application fields, based on their damping characteristics and/or accumulator capacity. Accordingly, various applications are possible with only a few accumulator concepts to reduce costs.

According to the invention, this object is basically achieved by a pressure accumulator where an interior of the accumulator housing is filled completely with the filling material. The filling material is in full surface contact with a wall of the accumulator housing. The filling material has cavities and/or forms at least one cavity for the at least partial accommodation of this pressure medium and/or at least one additional pressure medium.

The particular advantage of the pressure accumulator according to the invention is that, on flowing into the accumulator housing through the assignable housing opening, the pressure medium that is to be controlled by the accumulator, and is usually in the form of hydraulic fluid or a working gas in a pneumatic application, encounters the filling material that has been introduced into the accumulator housing. Meanwhile, the accumulator housing is filled at least partially with the filling material, so the accumulator capacity of the accumulator for the respective application case can be adjusted in the case of a hydraulic or pneumatic system. Depending on the degree of filling with the filling material, one and the same accumulator, depending on its fundamental accumulator design, can be adapted for a variety of application cases in the aforementioned technical systems. Standardized accumulators can then be mass produced and filled with different amounts of filling material. This ability leads to low manufacturing costs because of the benefits of mass production. For the first time, one delivered accumulator can be replaced with another accumulator filled with filling material to a different extent, permitting adapting the accumulator to modified specifications of the system, even on site, i.e. at the user's end. This adaptation ability permits cost savings at the user's end to this extent.

To be able to adjust the accumulator capacity in the accumulator housing accordingly, the filling material may be introduced as a solid block into the accumulator with a predefinable volume, in particular introducing it by molding or injection molding. The filling material then leaves free a cavity, at least within the accumulator housing, that defines the accumulator capacity of the accumulator and that can be filled with the respective working medium (fluid and/or gas). However, especially preferably, filling material in the form of a cellular structure is to be introduced into the respective accumulator housing of the pressure accumulator or hydraulic accumulator. The filling material is then designed to have cavities, possibly with closed pores, but preferably with open pores in its interior. The individual cavities then communicate primarily with one another through permeable fluid channels accordingly. The more the cavities are then integrated into the filling material and are formed by the filling material itself, the greater the increase in accumulator capacity of the accumulator modified in this way. The two types of cavity design described above can also be combined with one another.

The cavity volume or hollow compartment volume, which is adjustable and introduced into the accumulator through the filling material, is also suitable for damping the respective penetrating medium accordingly. The damping characteristic of the accumulator can also then be adjusted to this extent. In particular, the stiffness of the damping can be influenced in this way. A further adaptation to predefinable damping characteristics can be achieved if the filling material is designed to be at least partially flexible. A type of spring constant can then be stipulated as a damping constant at the manufacturing end for the respective pressure accumulator in a manner comparable to that with a compression spring.

Due to the delayed or limited admission of the pressure medium into the respective pressure accumulator, a homogeneous temperature profile can be developed inside the accumulator, which in turn protects the working medium, usually in the form of a hydraulic fluid or a pneumatic medium.

The filling material, with its cavities, is preferably formed from a sintered material and/or a cellular material, such as foam, a gel or a woven or nonwoven textile or a comparable textile material. If the filling material inside the pressure accumulator need not be elastically flexible, for example, in the implementation of the pressure accumulator as a simple gas storage bottle or some other fluid storage bottle, the filling material may also be made of a sintered ceramic or metallic material or a gelatinous substance. In a special embodiment, the filling material could also allow input of the medium to be introduced into the accumulator in the form of a bubble feed. The cavities are then created within the gel more or less only on the introduction of medium into the accumulator. With a corresponding reduction in the working pressure on the input end of the accumulator, the bubble feed is then released again within the gelatinous substance, and the medium that is introduced can be returned to the hydraulic or pneumatic working cycle.

However, with the pronounced elastic characteristic of the filling material, advantageously, the filling material is formed from an open-pore foam, preferably a polyurethane foam. If a textile material is used as the filling material, the textile material, in the form of a supporting structure or a supporting fabric, may serve as a backing for foam components, such as the aforementioned polyurethane foam. On the whole, the filling agent or filling material can basically be used for such structures or substrates that have a high accumulator capacity, preferably having a sufficient elastic flexibility, and can be introduced well into the internal structure of the accumulator in a permanent and thermally stable form.

In a preferred embodiment of the approach using the pressure accumulator according to the invention, the density of the filling material inside the pressure accumulator can be varied, in particular having a cluster or sandwich-type structure. The respective change in density can preferably be provided in at least one direction of orientation, for example, in the direction of the longitudinal axis of the pressure accumulator. If the filling material is in the form of foam, the differences in density can be created by repeated injection or foaming. For example, a gradient-type structure of the foam material would be possible, such that a very dense material is used on the input end of the accumulator and then, with open pores or with a lower density, changes rapidly in the direction of the opposite end of the accumulator housing. Instead of the pressure medium entering into the accumulator housing body, an increased resistance can then be built up in that the barrier property of the foam or some other filling material is increased accordingly. To ensure different densities and cavity structures, different filling materials can be used in some sections in the sense outlined above.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawing that forms a part of this disclosure and that is not drawn to scale:

FIG. 1 is a side elevational view in section of a fluid storage bottle, in particular a gas storage bottle, according to an exemplary embodiment of the invention.

DETAILED DESCRIPTION OF THE INVENTION

FIG. 1 shows a pressure accumulator 101 according to the invention in the form of a gas storage bottle. The gas storage bottle may be a nitrogen bottle in particular. The pressure accumulator 101 has an accumulator housing 103. A central section 105 of the accumulator housing 103 has a tubular design. Cup-shaped end pieces 107, 109, in particular in the form of hemispherical end pieces, are shaped on this tubular section 105. The end pieces 107, 109 each have an opening 111, 113 as the connection. An opening 113 is sealed with a stopper 115.

The interior 117 of the accumulator housing 103 is filled completely with a filling material, so that the filling material 119 is in full surface contact with the wall 120 of the accumulator housing 103. However, it is also conceivable for the interior 117 to be filled only partially with filling material 119. The accumulator volume can be adjusted in a flexible manner in this way. The filling material 119 contains a plurality of cavities into which the pressure medium 149 to be stored in the pressure accumulator 101 can flow in the form of a working gas such as nitrogen. The filling material 119 is a sintered material or a cellular material, such as a foam, in particular. Plastic foams are recommended here, in particular, but metal foams and woven or nonwoven textiles may also be used—as backings for foam materials. Meanwhile, the gaseous pressure medium 149 can completely permeate the filling material 119. The filling material 119 in the present case may, but need not necessarily, be elastically compressible. Due to this compressibility, a spring characteristic and/or a damping characteristic is formed. These characteristics are influenced by the choice of the filing material 119, its density, its arrangement in the gas storage bottle 101, its introduction temperature or working temperature, etc.

In a preferred embodiment of the hydraulic accumulator (not shown in detail), the foam-type filling material may also be filled into sandwich-type individual layers. The density profile and the damping properties of the foam can then be adjusted accurately in this way, in particular in the longitudinal direction LR of the accumulator. Furthermore, a homogeneous temperature profile is thus achieved within the accumulator during its operation, which profile protects the media introduced into the accumulator.

While one embodiment has been chosen to illustrate the invention, it will be understood by those skilled in the art that various changes and modifications can be made therein without departing from the scope of the invention as defined in the appended claims.

What is claimed is:

1. A pressure accumulator, comprising:

at least one accumulator housing having at least one connection for entry of a pressure medium to be stored in said accumulator housing and having an inner surface; and a filling material having cavities in said accumulator housing to accommodate the pressure medium and filling completely an interior of said accumulator housing, said filling material contacting said inner surface of said accumulator housing over a full area thereof, said filling material being formed from a cellular material having different densities within said accumulator housing created by one of repeated injection or repeated foaming.

2. A pressure accumulator according to claim 1 wherein said filling material is elastically compressible.

3. A pressure accumulator according to claim 1 wherein said different densities vary along a longitudinal axis of said accumulator housing.

4. A pressure accumulator according to claim 3 wherein said filling material is denser adjacent said connection.

5. A pressure accumulator according to claim 4 wherein said filling material becomes less dense in a direction away from said connection.

* * * * *